US006071101A

United States Patent [19]

Ni et al.

[11] Patent Number: 6,071,101

[45] Date of Patent: Jun. 6, 2000

[54] SCROLL-TYPE FLUID DISPLACEMENT DEVICE HAVING FLOW DIVERTER, MULTIPLE TIP SEAL AND SEMI-RADIAL COMPLIANT MECHANISM

[75] Inventors: Shimao Ni, Willowbrook; Philip C. Heitz, South Elgin, both of Ill.

[73] Assignee: Mind Tech Corp., Willowbrook, Ill.

[21] Appl. No.: 08/935,039

[22] Filed: Sep. 22, 1997

[51] Int. Cl.[7] ..... F01C 1/04

[52] U.S. Cl. ..... 418/55.5; 418/57; 418/151; 29/888.022

[58] Field of Search ..... 418/55.5, 57, 151; 29/888.022

[56] References Cited

U.S. PATENT DOCUMENTS

| | | | |
|---|---|---|---|
| 801,182 | 10/1905 | Creux | 418/142 |
| 3,600,114 | 8/1971 | Dvorak et al. | 418/57 |
| 3,802,809 | 4/1974 | Vulliez | 418/55.2 |
| 3,874,827 | 4/1975 | Young | 418/55.5 |
| 3,884,599 | 5/1975 | Young et al. | 418/55.5 |
| 3,924,977 | 12/1975 | McCullough | 418/57 |
| 3,989,422 | 11/1976 | Guttinger | 418/60 |
| 3,994,633 | 11/1976 | Shaffer | 418/55.5 |
| 3,994,636 | 11/1976 | McCullough et al. | 418/142 |
| 4,082,484 | 4/1978 | McCullough | 418/55.5 |
| 4,216,661 | 8/1980 | Tojo et al. | 418/15 |
| 4,357,132 | 11/1982 | Kousokabe | 418/55.5 |
| 4,437,820 | 3/1984 | Terauchi et al. | 418/55.4 |
| 4,477,238 | 10/1984 | Terauchi | 418/5 |
| 4,496,296 | 1/1985 | Arai et al. | 418/55.5 |
| 4,522,574 | 6/1985 | Arai et al. | 418/151 |
| 4,527,964 | 7/1985 | Mitsui et al. | 418/55.2 |
| 4,558,997 | 12/1985 | Sakata et al. | 418/55.2 |
| 4,609,334 | 9/1986 | Muir et al. | 418/55.5 |
| 4,611,975 | 9/1986 | Blain | 418/5 |
| 4,621,993 | 11/1986 | Nakamura et al. | 418/55.6 |
| 4,676,075 | 6/1987 | Shiibayashi | 62/469 |
| 4,869,658 | 9/1989 | Tsutsumi et al. | 418/55.4 |
| 4,877,382 | 10/1989 | Caillat et al. | 418/55.5 |
| 4,958,993 | 9/1990 | Fujio | 418/55.5 |
| 5,102,316 | 4/1992 | Caillat et al. | 418/55.5 |
| 5,330,335 | 7/1994 | Teracuhi et al. | 418/55.6 |
| 5,458,471 | 10/1995 | Ni | 418/55.5 |
| 5,547,354 | 8/1996 | Shimizu et al. | 418/151 |
| 5,582,513 | 12/1996 | Shigeoka et al. | 418/55.5 |

FOREIGN PATENT DOCUMENTS

| | | | |
|---|---|---|---|
| 59-176485 | 10/1984 | Japan | 418/55.4 |
| 60-98185 | 6/1985 | Japan . | |
| 2-45672 | 2/1990 | Japan | 418/55.5 |
| 3-11102 | 1/1991 | Japan . | |
| 3-88984 | 4/1991 | Japan | 418/55.4 |
| 3-237283 | 10/1991 | Japan . | |
| 4-5490 | 1/1992 | Japan . | |
| 4-121482 | 4/1992 | Japan . | |
| 5-87064 | 4/1993 | Japan | 418/55.4 |
| 2 255 595 | 11/1992 | United Kingdom | 418/55.2 |

*Primary Examiner*—John J. Vrablik
*Attorney, Agent, or Firm*—Richard G. Lione; Brinks Hofer Gilson & Lione

[57] ABSTRACT

A scroll-type fluid displacement device has two interfitting spiral-shaped scroll members which have predetermined geometric configurations. The novel design provides a flow diverter mechanism which directs intake fluid flow to break incompressible liquid accumulated into fine droplets which can be evenly engulfed by two suction pockets formed by the scrolls. This invention also provides a multiple groove tip seal mechanism for radially sealing off the compression pockets. This invention further provides a semi-radial compliant mechanism which maintains the radial compliant function of the orbiting scroll and at the same time transfers the load caused by the centrifugal force of the orbiting scroll from the scroll elements to the crank shaft.

7 Claims, 9 Drawing Sheets

SCROLL-TYPE FLUID DISPLACEMENT DEVICE HAVING FLOW DIVERTER, MULTIPLE TIP SEAL AND SEMI-RADIAL COMPLIANT MECHANISM

BACKGROUND OF THE INVENTION

This invention relates in general to a fluid displacement device. More particularly, it relates to an improved scroll-type fluid displacement device which has a flow diverter mechanism directing intake fluid flow to break incompressible liquid accumulated in a bearing housing into fine droplets which can be evenly engulfed by two suction pockets formed by the scrolls. This invention also relates to a multiple groove tip seal mechanism for radially sealing off compression pockets formed by the scrolls. This invention further relates to a semi-radial compliant mechanism which maintains radial compliant function of the orbiting scroll and at the same time its orbiting radius is predetermined such that the load on the fixed scroll exerted by the orbiting scroll due to the centrifugal force is shifted to the crank shaft.

Scroll-type fluid displacement devices are well-known in the art. For example, U.S. Pat. No. 801,182 to Creux, discloses a scroll device including two scroll members each having a circular end plate and a spiroidal or involute scroll element. These scroll elements have identical spiral geometry and are interfit at an angular and radial offset to create a plurality of line contacts between their spiral curved surfaces. Thus, the interfit scroll elements seal off and define at least one pair of fluid pockets. By orbiting one scroll element relative to the other, the line contacts are shifted along the spiral curved surfaces, thereby changing the volume of the fluid pockets. This volume increases or decreases depending upon the direction of the scroll elements' relative orbital motion, and thus, the device may be used to compress or expand fluids.

In scroll fluid compression application, it is necessary to supply oil to lubricate shaft bearings and a thrust bearing. Afterwards, the oil accumulates in the lowest spot in the compressor, called an oil sump, as disclosed in U.S. Pat. No. 3,994,633 to Shaffer. The oil is usually then re-circulated by an oil pump. This oil pump, however, not only consumes extra energy, it is also a potential cause of accident when it fails.

U.S. Pat. No. 3,994,636 to McCullough et al. discloses a tip seal mechanism for radial sealing between the compression pockets. In this mechanism, a tip seal is placed in a spiral groove at the tip of the scroll vane. It runs continuously along the spiral groove. The tip seal is urged by either a mechanical device, such as elastic material, or by a pneumatic force to contact the base of the other scroll member, and thus, to provide radial sealing. U.S. Pat. No. 4,437,820 to Tarauchi et al. discloses a mechanism using fluid pressure to drive a tip seal in the tip groove of one scroll member to contact the base of another scroll member. The mechanism disclosed by Tarauchi et al. has three shortcomings:

1) For convenience, the surface of the tip seal going to contact the base of the mating scroll member is called the tip surface. The surface of the tip seal that is opposite to the tip surface is called the back surface. The tip seal in the spiral groove extends from the central area to the peripheral. At different locations, the tip surface of the tip seal is subject to different pressure which can be briefly calculated as the average of the fluid pressure at both of its sides. At the central area, where the pressure acting on the tip surface of the tip seal is high, a high back pressure is needed to push the back surface of the tip seal to overcome the pressure on its tip surface. On the other hand, at the peripheral area, where the pressure acting on the tip surface is low, a low back pressure is needed. A single source of pneumatic force, while enough for the central region, will exert excessive force on the back surface of the tip seal at the peripheral area. This causes excessive friction loss and accelerates the wear of the tip seal.
2) U.S. Pat. No. 4,437,820 requires the tip seal loosely fitted in the groove. Thus, the urging fluid acting on the back surface of the tip seal will leak to the compression pockets from the gaps between the tip seal and the groove. This internal fluid leakage will lower energy efficiency and cause over heating.
3) A long tip seal, running from the central area to the peripheral, is subject to thermal expansion proportional to its length when working temperature increases. The longer the tip seal, the harder it is for it to fit in the groove under different temperatures.

U.S. Pat. No. 4,082,484 to McCullough et al. discloses a fixed-throw crank mechanism with a counterweight mounted on a hub bearing located at the peripheral of the orbiting scroll hub to counteract at least partially the centrifugal force of the orbiting scroll. This mechanism distributes the driving load and the centrifugal load separately onto two bearings, the driving load to the orbiting bearing inside the orbiting hub and the centrifugal load to the hub bearing outside the hub. Thus, the working condition of the bearings is greatly improved. This mechanism is only suitable, however, for a fixed-throw crank and not for a radially compliant mechanism, which has been proven to be a successful arrangement for scroll devices.

U.S. Pat. No. 3,924,977 to McCullough et al. discloses a mechanism having a radially compliant mechanical linking means which also incorporates means (i.e. a mechanical spring) to counteract at least a fraction of the centrifugal force exerted by the orbiting scroll member. This mechanism, however, does not have a counterweight mounted on a hub bearing located at the peripheral of the orbiting scroll hub. When the mass of the orbiting scroll and/or the crank shaft angular velocity become large, the centrifugal force can not be substantially counterbalanced by the linking mechanism. As a result, the flank of the orbiting scroll exerts excessive force caused by the orbiting centrifugal force on the flank of the fixed scroll. Hence, excessive wear and friction between scroll members and fatigue failure of the scroll elements take place.

To overcome the shortcomings of the above mentioned prior art, the present invention eliminates the use of an oil pump by using the suction fluid to carry over accumulated oil and to re-circulate it by the discharge fluid pressure. The present invention provides a flow diverter mechanism that makes intake fluid flowing in a predetermined direction of a channel capable of breaking the accumulated oil into droplets that can be evenly engulfed by two suction pockets formed by the scrolls. The present invention also provides a multiple groove tip seal mechanism for radially sealing off the compression pockets. The present invention further provides a semi-radial compliant mechanism which separately distributes the driving and centrifugal loads to two bearings on the orbiting scroll and maintains the radial compliant function of the orbiting scroll and at the same time transfers the centrifugal force of the orbiting scroll from the fixed scroll to the crank shaft.

SUMMARY OF THE INVENTION

Accordingly, it is an object of the present invention to provide a scroll-type displacement device comprising a main housing having an inlet port and at least one bearing, and an inlet fluid passage in communication with the inlet port. The scroll-type displacement device also comprises a drainage in communication with the at least one bearing and the inlet fluid passage, and a diverter for directing fluid flow in one direction.

It is also an object of the present invention to provide a scroll-type displacement device comprising a first scroll member and a second scroll member, with each of said scroll members having a scroll element extending outward from an end plate. Each scroll element has a tip and at least one of the tips has a groove with a closed first end near the center of the scroll element and a closed second end near the peripheral of the scroll element. The scroll-type displacement device further comprises an orifice located near the first end of the groove and pneumatically connecting the groove to a pressure source, and a seal element movably fitted in the groove.

It is further an object of the present invention to provide a scroll-type displacement device comprising a scroll member having a bearing hub with an orbiting bearing, and a shaft for transmitting a drive force to the scroll member. The scroll-type displacement device also comprises a slider fitted on the orbiting bearing and driven by the shaft. The slider drives the scroll member through the orbiting bearing. The scroll-type displacement device further comprises a hub bearing mounted on the bearing hub of the scroll member, and a front balancer mounted on the hub bearing. The scroll-type displacement device also has a drive device that makes synchronous rotation with the shaft and that drives the front balancer to make rotation relative to the scroll member.

DETAILED DESCRIPTION OF THE PRESENTLY PREFERRED EMBODIMENTS

Figure 1:
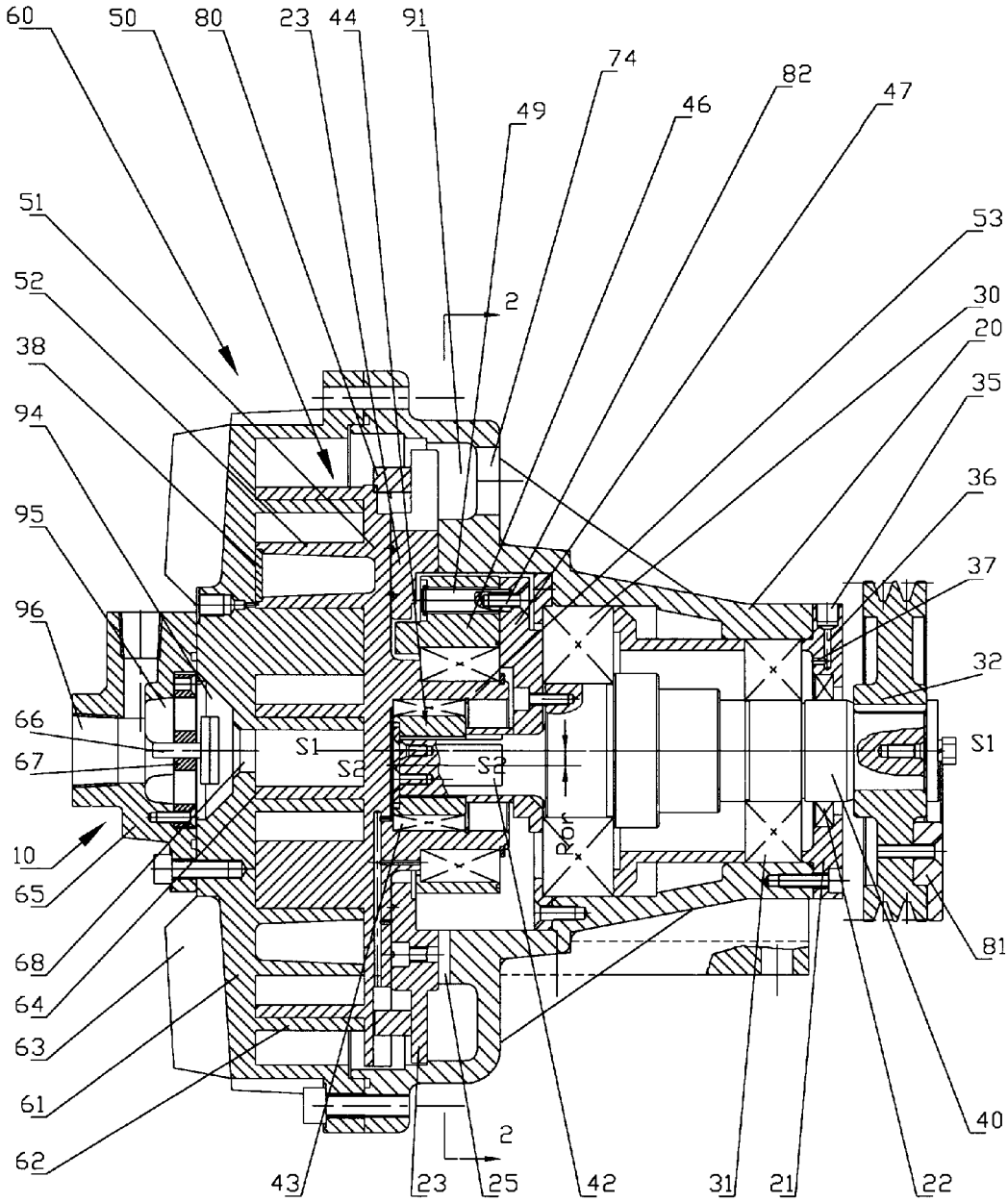
FIG. 1 illustrates a cross-section of a scroll compressor constructed in accord with the present invention.

Referring to FIG. 1, a scroll-type fluid compressor designed in accordance with the present invention is shown. The compressor unit 10 includes a main housing 20, a first scroll member 60, and a second scroll member 50. A rear cover 21 with a shaft seal 22 is attached to the main housing 20 in a conventional manner (e.g. bolting). The main housing 20 holds front bearing 30 and rear bearing 31. A main shaft 40 is rotatably supported by the bearings 30, 31 and rotates along its axis S1—S1 when driven by an electric motor or engine (not shown) via a pulley 32. A shaft seal 22 seals the shaft 40 to prevent lubricant and fluid inside the housing from escaping and outside fluid and dirt from entering. A drive pin 42 extrudes from the front end of main shaft 40, and the central axis of the drive pin, S2—S2, is offset from the main shaft axis, S1—S1, by a distance equal to the orbiting radius $R_{or}$ of the second scroll member 50. The orbiting radius is the radius of the orbiting circle which is traversed by the second scroll member 50 as it orbits relative to the first scroll member 60.

The first scroll member 60 has an end plate 61 from which a scroll element 62 extends. The first scroll member 60 is attached to the main housing 20 in a manner that appropriate gaps, indicated by reference numeral 64, are maintained between the tip of the scroll element of one scroll member and the base of the end plate of the other scroll member. In addition, the first scroll member 60 includes a reinforcing rib 63 and a discharge connector 65. A check valve 66 and a check valve guide 67 are located inside the discharge connector 65. During operation of the compressor, the check valve 66 opens the discharge port 68 on the first scroll member 60. When the compressor stops, the check valve 66 closes the discharge port 68.

The second scroll member 50 includes a circular end plate 51 and a scroll element 52 affixed to and extending from the front surface of the end plate 51. The second scroll member 50 also has an orbiting bearing hub 53 affixed to and extending from the rear surface of the end plate 51.

Figure 3:
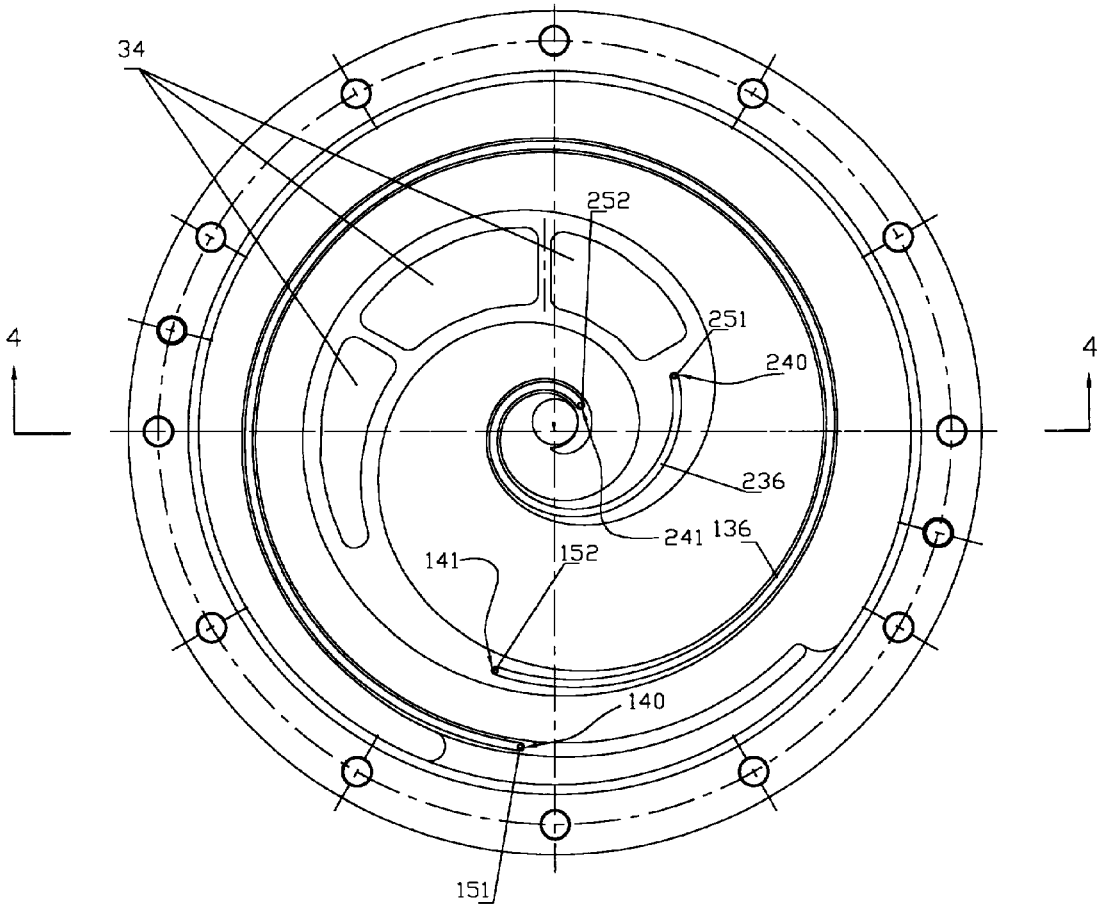
FIG. 3 illustrates a scroll member of the scroll compressor of FIG. 1 with grooves of a multiple groove tip seal mechanism in accord with the present invention.
Figure 4:
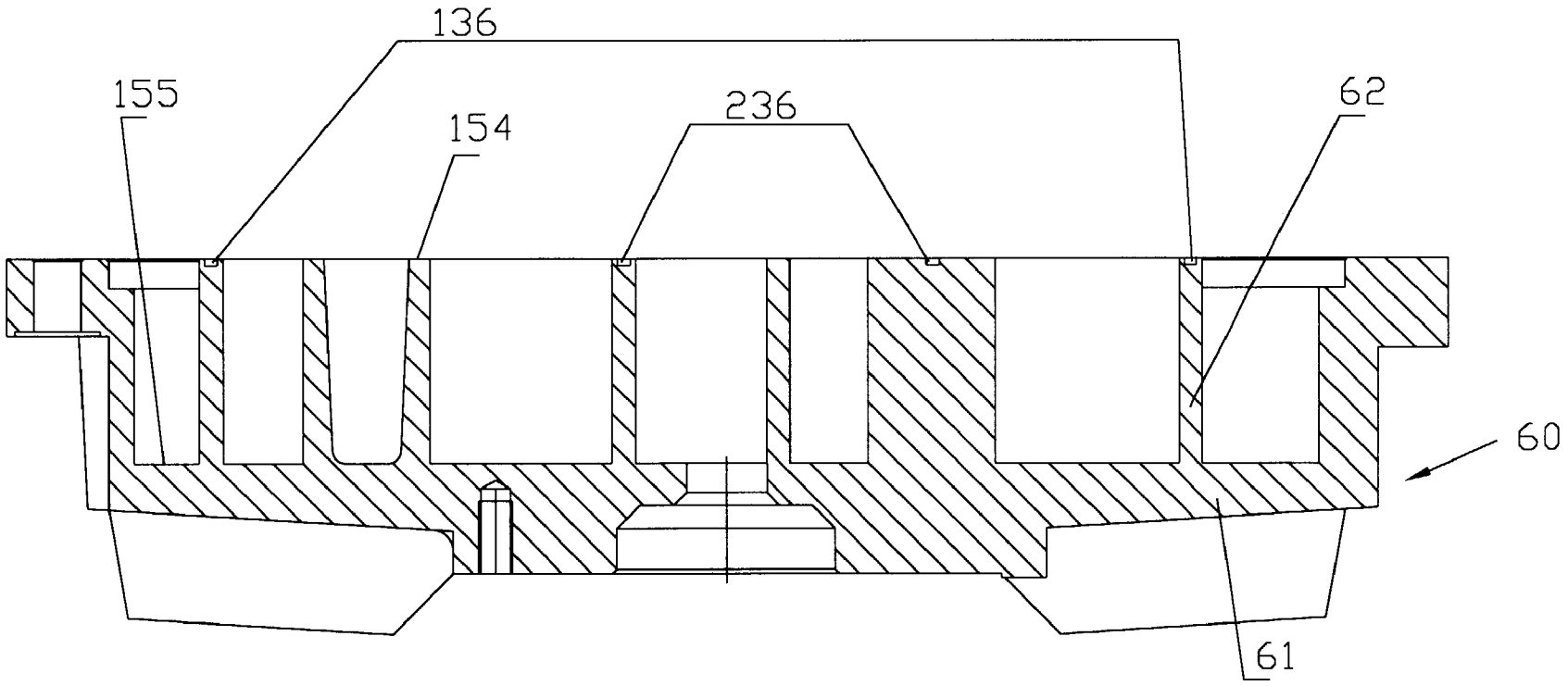
FIG. 4 illustrates a cross section view of the scroll member of FIG. 3 taken along line 4—4.
Figure 5C:
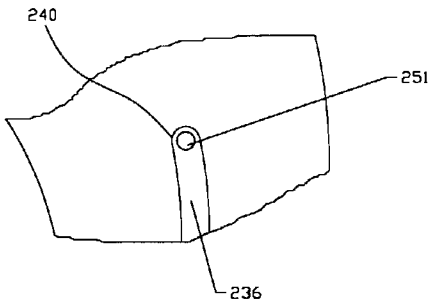
FIGS. 5*a–d* illustrate partial views of the grooves of the multiple groove tip seal mechanism of FIG. 3.
Figure 5A:
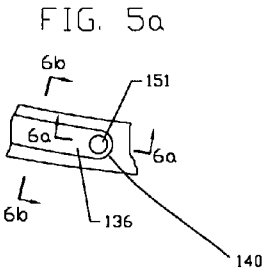
Figure 5D:
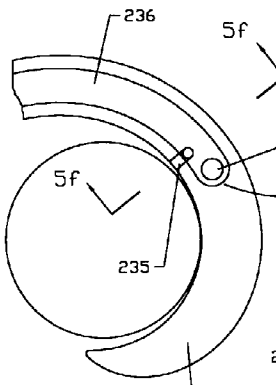
Figure 5E:
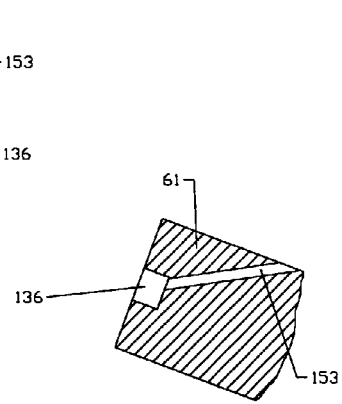
FIG. 5*e* illustrates a cross-section view of the groove of the multiple groove tip seal mechanism of FIG. 5*b* taken along line 5*e*—5*e*.
Figure 5F:
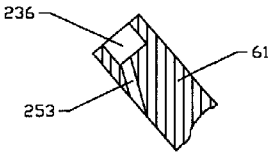
FIG. 5*f* illustrates a cross-section view of the groove of the multiple groove tip seal mechanism of FIG. 5*d* taken along line 5*f*—5*f*.
Figure 5B:
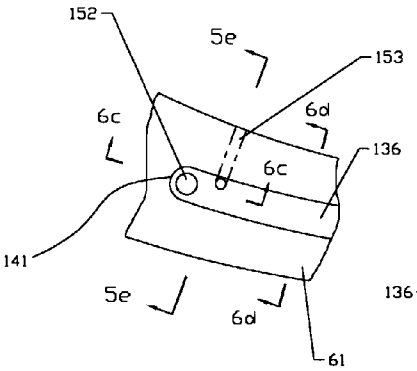
Figure 6A:
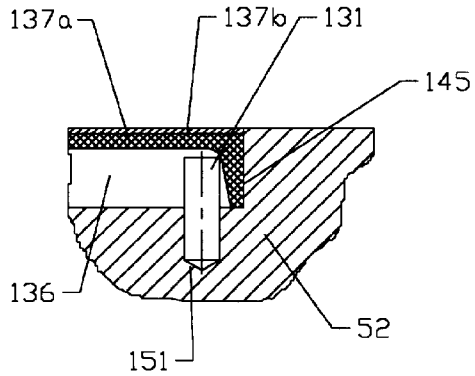
FIGS. 6*a–b* illustrate cross-section views of the groove of the multiple groove tip seal mechanism of FIG. 5*a* with a tip seal element and a tip friction element taken along line 6*a*—6*a* and line 6*b*—6*b*, respectively.
Figure 6C:
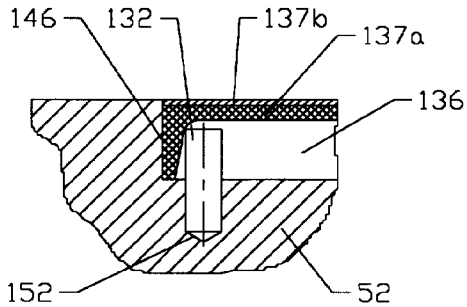
FIGS. 6*c–d* illustrate cross-section views of the groove of the multiple groove tip seal mechanism of FIG. 5*b* with a tip seal element and a tip friction element taken along line 6*c*—6*c* and line 6*d*—6*d*, respectively.
Figure 6B:
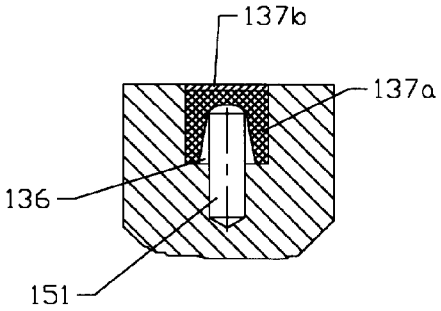
Figure 6D:
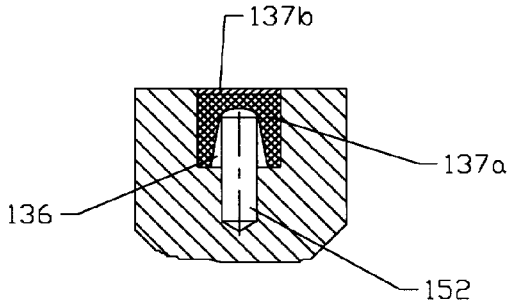
Figure 7A:
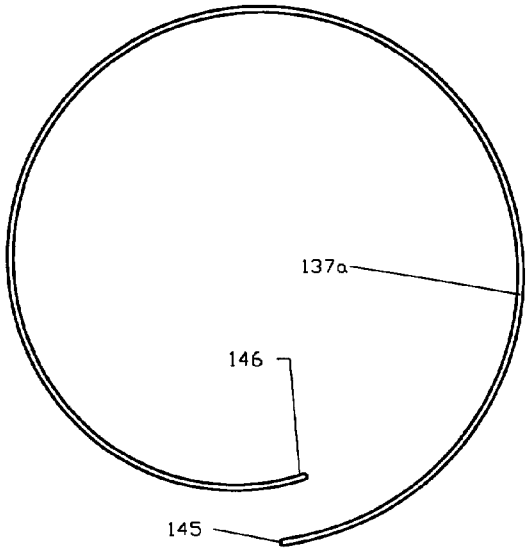
FIGS. 7*a–c* illustrate perspective views of the tip seal element of the multiple groove tip seal mechanism of FIG. 3.
Figure 7D:
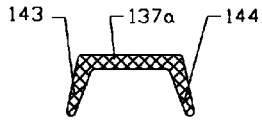
FIGS. 7*d–f* illustrate cross-section views of the tip seal element of the multiple groove tip seal mechanism of FIG. 7*c* taken along line 7*d*—7*d*, line 7*e*—7*e*, and line 7*f*—7*f*, respectively.
Figure 7B:
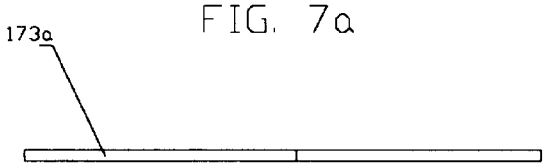
Figure 7E:
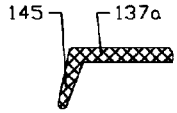
Figure 7C:
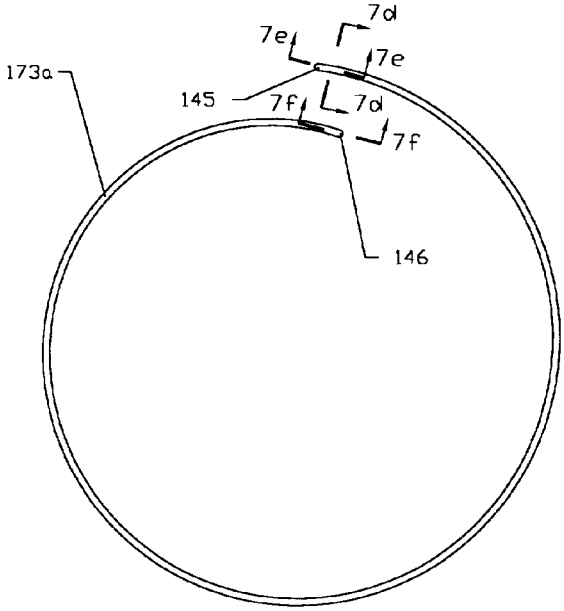
Figure 7F:
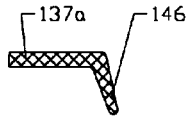

The scroll elements of the scroll members may each have one or more cut-outs 34, as best shown in FIG. 3. These cut-outs 34 reduce the weight of the scroll elements, with little or no reduction in their effectiveness. The cut-outs 34 may be of any desirable shape or size depending on manufacturing and consumer preferences. Preferably, the cut-outs of the scroll element of the orbiting scroll are also sealed off from fluid by plate 38, as shown in FIG. 1.

Scroll elements 52 and 62 are interfit at 180 degree angular offset, and at a radial offset having an orbiting radius $R_{or}$. At least one pair of sealed off fluid pockets is thereby defined between scroll elements 52 and 62, and end plates 51 and 61. The second scroll member 50 is connected to the driving pin 42, through a driving pin bearing 43 and a driving slider 44, and to a rotation preventing oldham ring 80. The second scroll member 50 is driven in an orbital motion at the orbiting radius $R_{or}$ rotation of the drive shaft 40 to thereby compress fluid. The working fluid enters the compressor 10 from the inlet port 74 and then enters the inlet fluid passage 91. The inlet fluid passage 91 is formed between housing 20 and thrust bearing 23 as shown in FIG. 1.

Figure 2:
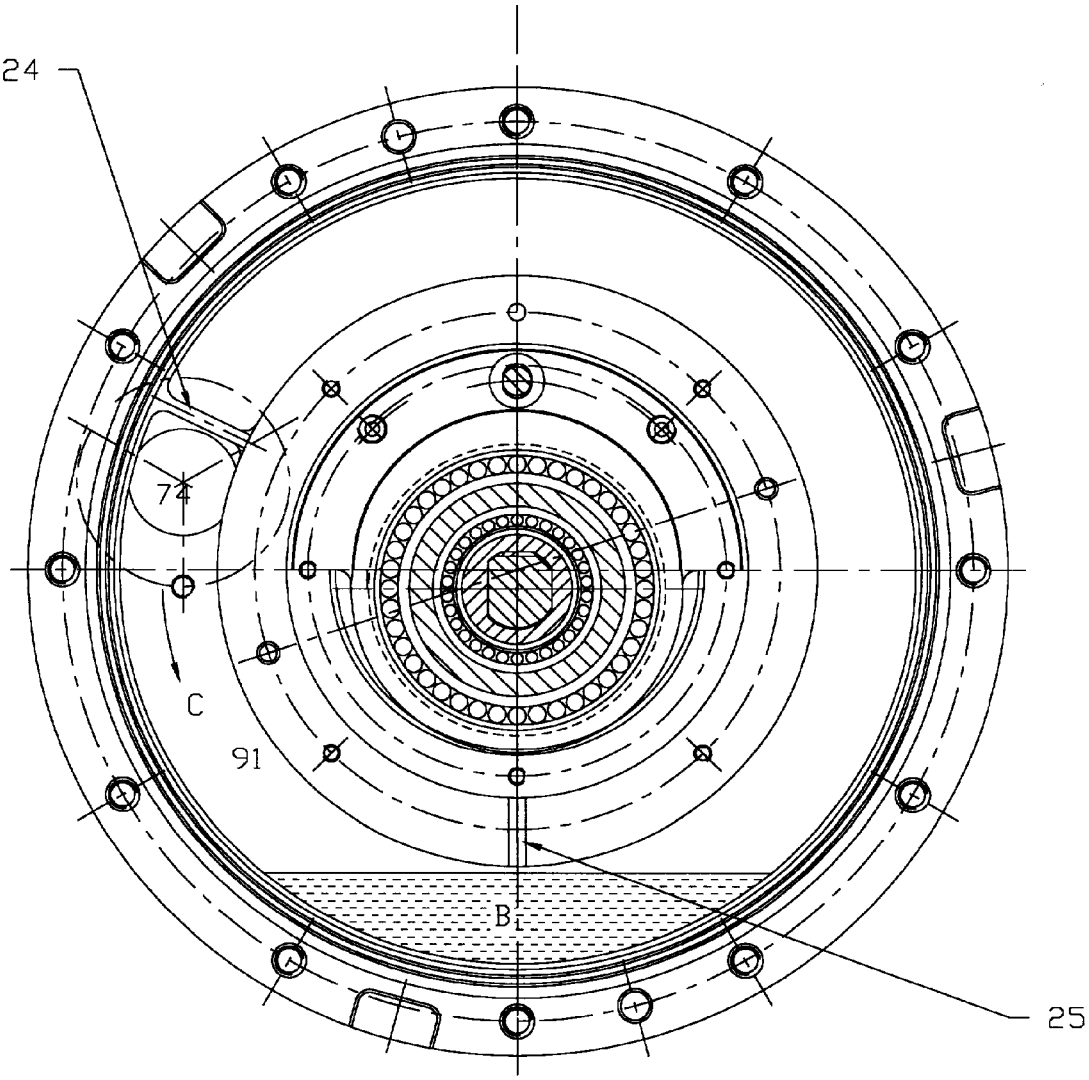
FIG. 2 illustrates a fluid diverter mechanism of the present invention in a cross-section view of the scroll compressor of FIG. 1 taken along line 2—2.

Referring to FIGS. 1–2, the flow diverter mechanism of the present invention will be described. Lubricant oil enters main housing 20 through port 35 and passages 36 and 37. After lubricating shaft bearings 30, 31, crank pin bearing 43, and thrust bearing 23, excess oil flows through a drainage 25 to area B as shown in FIG. 2. As soon as entering inlet port 74, the intake fluid is deflected by a diverter 24 that prevents the intake fluid from flowing in a clockwise direction. Thus, the intake fluid can only flow downward (counterclockwise) as shown by arrow C along the fluid passage 91. This unidirectional flow has enough velocity to blow up and break down the oil accumulated in area B into small droplets. The oil droplets are carried away by the fluid flow and then evenly engulfed by the suction pockets formed between the first and second scroll members 60, 50. Thus, the excessive load on the oldham ring and the vibration and noise, caused by periodical oil accumulation and suddenly uneven engulfment of the accumulated oil into the suction pockets, are eliminated. From inlet fluid passage 91 the fluid enters the suction pockets (not shown) between the two scroll members and then is compressed by the scroll members. The compressed fluid discharges through discharge hole 68, chambers 94, 95 and discharge port 96.

Referring to FIGS. 3, 4, 5*a–f*, 6*a–d*, and 7*a–f*, the multiple groove tip seal mechanism of the present invention will be described. Although the following discussion refers to the tip seal mechanism of the first scroll member, it is equally applicable to the second scroll member. The first scroll member 60 has a tip 154 and a base 155. At the tip 154 of the first scroll member 60 there are a first groove 136 and a second groove 236 separate and apart from the first groove. The first and second grooves are located in the peripheral and central portion of the spiral tip of the first scroll member, respectively. The direction along which the spiral shaped groove extends shall be referred to as longitudinal. In order to eliminate redundancy and unnecessary repetition, only the first groove 136 will be described in detail below, since the detailed structure of groove 136 is the same as groove 236 except for the longitudinal length and curvature. The same reference numerals that are used to describe the first groove 136 are applicable to the second groove 236, except that the first digit of each numeral used to reference the first groove (namely "1") is replaced by a "2" in referencing the second groove. For example, the reference numeral of 136 for the first groove becomes 236 for the second groove.

The first groove 136 has a first end 140 near the peripheral of the spiral vane of the first scroll member, and a second end 141 opposite the first end. The fluid pressure near the second end is higher than that near the first end. Referring to FIGS. 3 and 5*a–f*, groove 136 has a first pin hole 151 at its first end 140 and a second pin hole 152 at its second end 141. Referring to FIGS. 6*a–d* pins 131 and 132 are disposed in the first and second pin holes 151, 152, respectively. Referring to FIGS. 6*a–d* and 7*a–f*, tip seal element 137*a* is of a closed spiral shape in the longitudinal direction and has both a first end 145 and a second end 146. Pins 131 and 132 hold the first and second ends of seal element 137*a* tightly against the first and second ends of the groove 136, respectively. Thus tip seal element 137*a* can effectively seal both ends of groove 136 without being affected by thermal growth. In addition, a tip friction element 137*b* may be disposed on the top of tip seal element 137*a*. Tip seal element 137*a* and tip friction element 137*b* may be separate or integral with each other.

Near the second end 141 of the groove 136 there is an orifice 153, located at the bottom of the groove 136 and pneumatically connecting the groove to the high pressure fluid. The location of the orifice 153 is selected so that the optimum seal pressure is introduced into groove 136. This so called optimum seal pressure refers to the minimum pressure at which the fluid introduced into the groove 136 is capable of pushing the tip seal element 137*a* and the tip friction element 137*b* up against the base of the mating scroll, and thus, to provide radial sealing between compression pockets formed by the two scrolls.

Figure 8:
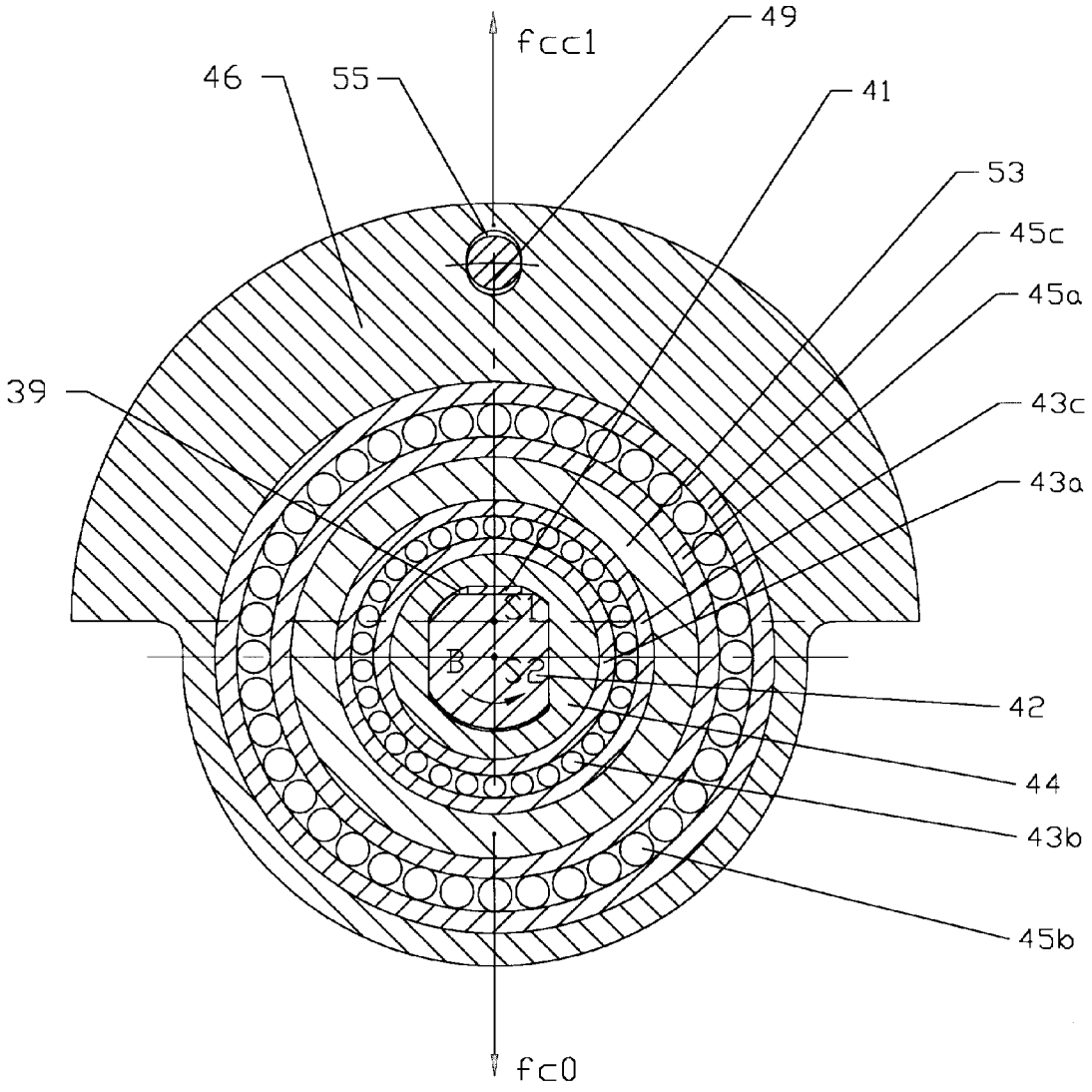
FIG. 8 illustrates a semi-radial compliant mechanism of the present invention in a partial cross-section view of the scroll compressor of FIG. 1 taken along line 2—2.
Figure 9:
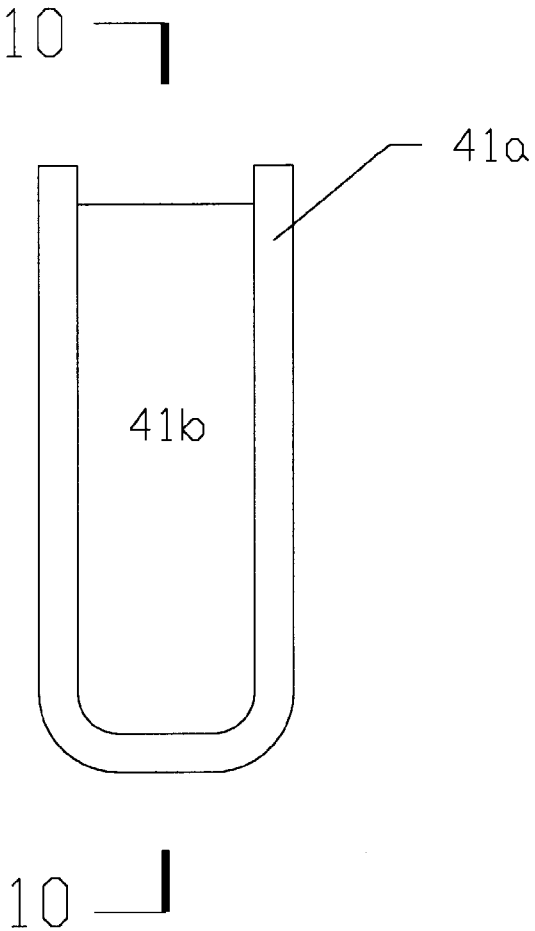
FIG. 9 illustrates a side view of a spacer of the semi-radial compliant mechanism of FIG. 8.
Figure 10:
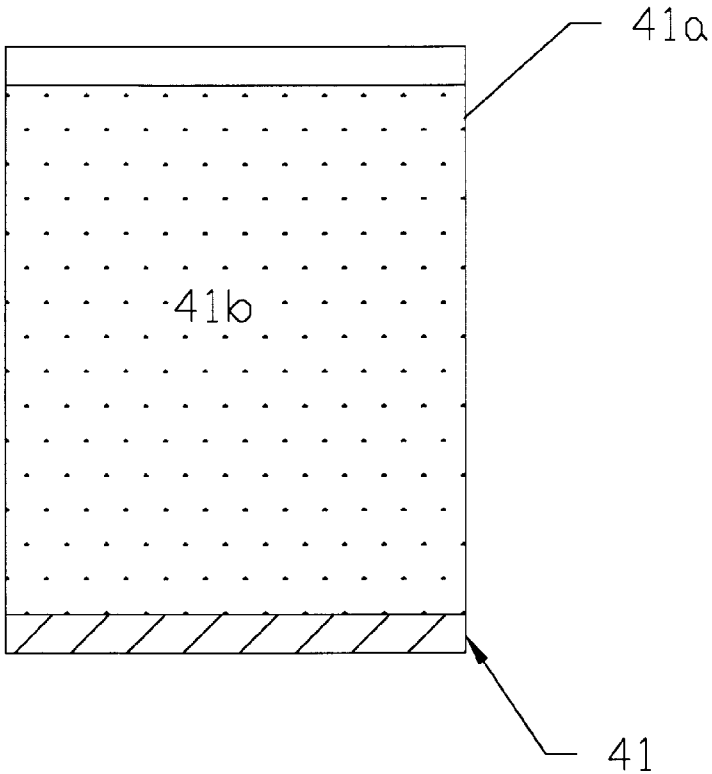
FIG. 10 illustrates a cross-section view of the spacer of FIG. 9 taken along line 10—10.

Referring to FIGS. 1 and 8–9, the semi-radial compliant mechanism of the present invention with a counterweight on the periphery of the orbiting scroll bearing hub will be described. When shaft 40 rotates, the crank pin 42 drives a slider 44 to make counterclockwise rotation as shown by arrow B in FIG. 8. The slider 44 then in turn drives the second scroll member hub 53 through bearing inner race 43*a*, rollers 43*b* and outer race 43*c* (collectively 43*a*–43*b*–43*c*). The second scroll member 50 makes orbiting motion under the guidance of oldham ring 80 and is acted upon by centrifugal force Fco.

As shown in FIG. 1, middle balancer 47 is attached to shaft 40. A pin 49 is located in an oval hole 55 in the front balancer 46 and is attached to the middle balancer 47 by a screw 82. When the middle balancer 47 rotates together with the shaft 40, the pin 49 drives the front balancer 46. The front balancer 46 is attached to the hub 53 of the second scroll member 50 through a bearing inner race 45*a*, rollers 45*b* and an outer race 45*c* (collectively 45*a*–45*b*–45*c*). When the second scroll member 50 orbits with respect to the first scroll member 60, the front balancer 46 rotates around the hub 53 of the second scroll member 50. The centrifugal force Fcc1 acting on front balancer 46 balances part of the centrifugal force Fco acting on the second scroll member 50. The oval hole 55 enables the second scroll element 52, together with bearing 43*a*–43*b*–43*c*, slider 44, bearing 45*a*–45*b*–45*c*, and front balancer 46, to move towards the first scroll element 62 (i.e. increases the eccentricity $R_{or}$) under the net force (Fco–Fcc1).

A spacer 41 is inserted into space 39 between the slider 44 and the crank pin 42, as shown in FIG. 8. The spacer 41 has a very carefully made thickness such that the clearance between the first and the second scroll elements 62 and 52 is ranges from zero to δ, which is the machining accuracy of the scroll elements. In other words, the second scroll element 53, the bearing 43*a*–43*b*–43*c*, the front balancer 46, the bearing 45*a*–45*b*–45*c* and the slider 44 would move under the force (Fco–Fcc1) until the slider 44 is stopped by the drive pin 42 through the spacer 41 or the second scroll element 53 is stopped by the first scroll element 63 due to flank contact between the scroll elements. In the latter case, when high spots on the flanks of the scroll elements wear out, the drive pin 42 and the spacer 41 will eventually stop the slider 44, and in turn stop the second scroll element 52 from further moving towards the first scroll element 62. Thus, there is zero clearance between the flanks of the first and second scroll elements after break-in of the scroll elements. In this case, the net centrifugal load (Fco–Fcc1) will be transferred from the scroll elements to the crank pin 42 to prevent fatigue of the first and second scroll elements. However, when the radial separating force acting on the second scroll member becomes excessive due to liquid compression or contaminants jammed between the flanks of the two scroll members, the second scroll member 50, and the attached parts (i.e. slider 44, bearing 43*a*–43*b*–43*c*, bearing 45*a*–45*b*–45*c*, and front balancer 46) will yield in the direction opposite to the centrifugal force Fco to increase the gap between the flanks of the two scroll elements.

Preferably, the spacer 41 is made of an epoxy material. As shown in FIG. 9, a thin shim 41*a* is fitted with epoxy 41*b*. The amount of epoxy disposed in the shim is carefully weighed to sufficiently fill in the space 39, yet prevent the excess spreading of the epoxy.

When the compressor starts, the net centrifugal force (Fco–Fcc1) drives the second scroll hub, and in turn the slider 44, downward (FIG. 8). The slider 44 squeezes the spacer 41 and changes its thickness until the second scroll flank is stopped by the first scroll flank. The compressor keeps running until the spacer 41 of epoxy eventually cures.

Alternatively, the spacer 41 may be made of a metal, plastic, or like material. This is accomplished by measuring the space 39 and designing the spacer 41 to fit within the space 39.

The above arrangement gives the second scroll member 50 radial moving freedom just like in the full radial compliant arrangement known in the art, but restricts this radial freedom within a controlled range. As a result, after initial brake-in, there is zero clearance and zero interference between the flanks of the two scroll elements, unlike the full radial compliant arrangement known in the art in which the flank-flank contact is constantly maintained during normal operation. The semi-radial compliant arrangement of the present invention unloads the centrifugal force from the first and second scroll elements to the crank pin. Accordingly, this arrangement is particularly useful when centrifugal force can be excessive under various operation conditions or when the scroll member material used has a low fatigue strength, such as aluminum alloy.

The mechanisms of the present invention described above and shown in detail in FIGS. 1–9 may be used with several different prior art scroll devices. In particular, these mechanisms are suitable for use with the scroll device disclosed in U.S. Pat. No. 5,458,471, commonly assigned with the present application and specifically incorporated herein by reference.

While the above-described embodiments of the invention are preferred, those skilled in this art will recognize modifications of structure, arrangement, composition and the like which do not part from the true scope of the invention. The invention is defined by the appended claims, and all devices and/or methods that come within the meaning of the claims, either literally or by equivalents, are intended to be embraced therein.

We claim:

1. A scroll-type displacement device, comprising:

a) a scroll member having a bearing hub;

b) an orbiting bearing;

c) a shaft for transmitting a driving force to said scroll member;

d) a slider on said shaft inside said orbiting bearing and driven by said shaft, said slider driving said scroll member through said orbiting bearing;

e) a front balancer mounted on said bearing hub;

f) a drive connection between said shaft and said front balancer for rotating said front balancer relative to said scroll member; and g) a spacer of predetermined thickness between said shaft and said slider, said spacer comprising a material which cure hardens after the spacer has been compressed between said shaft and said spacer to a thickness less than said predetermined thickness.

2. The device defined in claim 1 wherein said drive connection includes a drive pin fixed with respect to said shaft.

3. The device defined in claim 2 wherein said front balancer has a slot, said drive pin is fitted into said slot to drive said front balancer, and said front balancer slides with respect to said drive pin.

4. A scroll-type displacement device, comprising:

a) a fixed scroll member having a spiral scroll element with an engagement flank;

b) a movable scroll member having a spiral scroll element with an engagement flank and mounted for orbital movement relative to said fixed scroll member;

c) an orbiting bearing;

d) a shaft for transmitting driving force to said orbitally movable scroll member;

e) a slider on said shaft inside said orbiting bearing and driven by said shaft, said slider driving said movable scroll member through said orbiting bearing;

f) a balancer mounted on said bearing hub for rotation relative thereto;

g) a drive connection between said shaft and said balancer for rotating said balancer;

h) a spacer of predetermined thickness between said shaft and said slider, said spacer comprising a material which cure hardens after it has been compressed by net centrifugal forces acting on it during run-in of the device until radial movement of the movable scroll member toward the fixed scroll member under the effect of those net centrifugal forces is stopped by operational engagement of said flanks on said scroll members.

5. A scroll-type displacement device comprising:

a) a scroll member having a bearing hub and an orbiting bearing;

b) a shaft for transmitting a drive force to said scroll member;

c) a slider fitted on said orbiting bearing and driven by said shaft, said slider driving said scroll member through said orbiting bearing;

d) a front balancer mounted on said bearing tub;

e) a drive device making synchronous rotation with said shaft and driving said front balancer to make rotation relative to said scroll member; and f) at least one spacer is inserted into a space between said slider and said crank pin, said spacer having a predetermined thickness and comprising an epoxy material.

6. A method of constructing a spacer between a surface on the outside of a drive shaft in a scroll type displacement device and an opposed surface inside a slider mounted on said shaft, comprising the steps of:

a) forming a sheet of epoxy materials of predetermined thickness;

b) placing the sheet of epoxy material between said outside and inside surfaces before it has cured;

c) rotating said shaft to drive said scroll type displacement device while said epoxy material is curing so that the surfaces compress the epoxy material to its optimum thickness for operation before it has completely cured.

7. The method of claim 6 further characterized by and including the step of:

a) forming the sheet of epoxy material on a shim.

* * * * *